US009308152B2

(12) United States Patent
David A. et al.

(10) Patent No.: US 9,308,152 B2
(45) Date of Patent: Apr. 12, 2016

(54) SHIELD FOR ORAL DEVICES FOR INFANTS

(76) Inventors: Tesini David A., Hopkinton, MA (US); Joshua P. Wiesman, Boston, MA (US)

( * ) Notice: Subject to any disclaimer, the term of this patent is extended or adjusted under 35 U.S.C. 154(b) by 0 days.

(21) Appl. No.: 13/218,734

(22) Filed: Aug. 26, 2011

(65) Prior Publication Data

US 2012/0053631 A1 Mar. 1, 2012

Related U.S. Application Data

(60) Provisional application No. 61/377,655, filed on Aug. 27, 2010.

(51) Int. Cl.
*A61J 17/00* (2006.01)

(52) U.S. Cl.
CPC ..... *A61J 17/00* (2013.01); *A61J 17/008* (2015.05)

(58) Field of Classification Search
CPC ..... A61J 17/00; A61J 17/002; A61J 17/003; A61J 17/005; A61J 17/006; A61J 17/007; A61J 17/008; A61J 11/04; A61J 11/045; A47G 19/2266; A47G 19/2272
USPC ..... 606/234–236; 220/711–714; D24/194–199
See application file for complete search history.

(56) References Cited

U.S. PATENT DOCUMENTS 4,403,613 A * 9/1983 Panicci ..... 606/236
5,275,619 A * 1/1994 Engebretson et al. ..... 606/236
5,868,131 A * 2/1999 Murchie ..... 128/204.13
6,080,186 A * 6/2000 Pedersen et al. ..... 606/234
6,767,357 B2 * 7/2004 Uehara et al. ..... 606/235
6,773,451 B1 8/2004 Dussere
7,294,141 B2 11/2007 Bergersen
2008/0172089 A1 * 7/2008 Fernandez ..... 606/236
2010/0063543 A1 * 3/2010 Moses et al. ..... 606/236

FOREIGN PATENT DOCUMENTS

JP 2000245811 A * 9/2000 ..... A61J 17/00

OTHER PUBLICATIONS

Tonkin, S., et al; Positional upper airways narrowing and an apparent life threatening event; New Zealand Medical Journal, Apr. 26, 2002; vol. 115; pp. 193-194.

(Continued)

*Primary Examiner* — David C Eastwood
*Assistant Examiner* — Martin T Ton
(74) *Attorney, Agent, or Firm* — Brian M. Dingman; Dingman IP Law, PC

(57) ABSTRACT

A shield for a pacifier, teether, feeding device, sippy cup or the like. The shield carries a structure that is adapted to be inserted into the mouth of a young child. There is a body defining an opening at which the structure is carried and an inner surface surrounding this opening and encompassing the perioral areas surrounding the lips. The body defines a superior portion superior to the opening and an inferior portion inferior to the opening, and defines a lateral axis passing laterally through the opening. The superior portion is generally concave laterally on both sides of the vertical midline, to define an inner surface that closely conforms to the upper lip and perioral areas. At least the part of the inferior portion close to and on either side of the vertical midline is offset outward away from the face compared to the inner surface of the superior portion that is close to and on either side of the vertical midline, to allow the mandible to move anteriorly without being inhibited by the shield.

12 Claims, 14 Drawing Sheets

(56) References Cited

OTHER PUBLICATIONS

Tonkin, S.; Sudden Infant Death Syndrome: Hypothesis of Causation; Pediatrics; May 1974; vol. 55, No. 5; pp. 650-661.
Bouchard, C., et al; Management of obstructive sleep apnea: role of distraction osteogenesis; Oral Maxillofac Surg Clin North Am.; Nov. 2009; 21(4); 459-75 (abstract only).
Rees, K., et al; Facial structure in the sudden infant death syndrome: case-control study; BMJ, vol. 317, Jul. 18, 1998; 179-180.
Tonkin, S., et al; Effect of pacifier use on mandibular position in preterm infants; Acta Paediatricia; vol. 96, Issue 10; Oct. 2007; 1433-1436 (abstract only).
Waitzman, A, et al; Craniofacial Skeletal Measurements Based on Computed Tomography: Part II Normal Values and Growth Trends; Cleft Pal-Cranio Jnl; 29(2); Mar. 1992; 118-28.
White, J, et al; Three-dimensional facial characteristics of caucasian infants without cleft and correlation with body measmnts; Cleft Pal-Cranio Jnl; 41(60); Nov. 2004; 593-02.
Yamada, T, et al; Three-dimensional analysis of facial morphology in normal Japanese children as control data for cleft surgery; Cleft Pal-Cranio Jnl; 39(5); Sep. 2002; 517-26.
Young, J; Selected facial measurements of children for oxygen-mask design; Office of Aviation Medicine, Federal Aviation Agency; Apr. 1966.
International Search Report and Written Opinion of International Searching Authority issued in corresponding application No. PCT/US11/49324 mailed Dec. 22, 2011.
International Preliminary Report on Patentability mailed on Mar. 14, 2013 re: International Application No. PCT/US2011/049324 (8 pages).

* cited by examiner

SHIELD FOR ORAL DEVICES FOR INFANTS

CROSS-REFERENCE TO RELATED APPLICATION

This application claims priority of Provisional Patent Application Ser. No. 61/377,655 filed on Aug. 27, 2010.

FIELD

This disclosure relates to a shield for a pacifier or other structure that is to be placed in the mouth of an infant.

BACKGROUND

Once an infant begins to turn his head with neck extension, suckling becomes an active oral pattern with large up and down and forward/back movements of the jaw; and rhythmic forward/back movement of a cupped tongue. The newborn's respiratory function is characterized by obligatory nasal breathing because of the close approximation of the tongue to the soft palate and posterior pharyngeal wall, which can obstruct oral airway patency.

The perioral region is richly supplied with neural mechanoreceptors capable of inducing the tissue changes associated with movements of the lower face (Barlow 1991).

Human lip muscles display excitatory reflex responses. Particular attention is directed to the obicularis oris, buccinators muscles, mentalis muscles and underlying bone as being supportive/resting areas of the pacifier shield.

Oral shields are commonly used in applications such as pacifiers, teethers, feeding devices and sippy cups. Shield designs (Panicci, U.S. Pat. No. 4,403,613 and Uehara, U.S. Pat. No. 6,767,357) disclose the lower part of the shield slightly curving away from the face. The Panicci design is not sufficiently offset to allow for free forward posturing of the mandible. Additionally, Panicci does not recognize the need to be supportive only on upper arch, and is not designed based on available anthropometrics. Panicci (in contradiction to the present invention) will intensify the sensory and motor components against the lower lip and contribute a retrusive stimulation and force against the mandible and other areas below the upper arch and intermaxillary space. This reflex will actually cause more restriction of the upper airway.

The relative magnitudes of lip-muscle reflex components are known to vary in a systematic manner with the stimulation of the lip muscle and site of stimulation.

Current designs of pacifier baglets (to be differentiated from the pacifier shield) claim benefits to orthodontic development, particularly of the maxillary arch. These designs are often paired with different oral shields for corresponding size or marketing purposes. Beyond these claims of orthodontic benefits, pacifiers have also been shown to reduce the incidence of SIDS (Sudden Infant Death Syndrome). The mechanism of this protection is believed to be in the maintenance of a patent oral airway during infant sleeping in a supine position and pacifier sucking. It has been hypothesized that the association of pacifier use with reduced risk of Sudden Infant Death may be mediated by forward movement of the mandible and tongue. Pacifier use helps to open the upper airway and further to move the mandible forward when an infant is sucking on a pacifier (Tonkin S L, Lui D, McIntosh C G, Rowley S, Knight D B, Gunn A J., Effect of Pacifier Use on Mandibular Position in Preterm Infants, Acta Paediatr, 2007, October; 96(10):1433-6. Epub 2007 Aug. 20). Retroposition of mandibles have been considered an additional risk factor for sudden infant death. (Rees K, Facial Structure in the sudden infant death syndrome: case control study, BMJ1998 317:179-180) Forward posturing of the mandible may therefore increase the efficiency of the oral airway. Further Tonkin found that there was significant forward movement of the mandible when premature infants were sucking on a pacifier, and he proposed that the common pathologic mechanism of SIDS was airway occlusion by backward displacement of the tongue and mandible (Tonkin S L et al., Positional upper airways narrowing and an apparent life threatening event, NZ Med J 2002 115:193-4; Tonkin S., Sudden Infant Death Syndrome: Hypothesis of Causation, Pediatrics 1975; 55:650-661).

Further, treatment of airway obstruction by mandibular advancement and distraction osteogenesis, used to eliminate mandibular retrognathia and malposition of the tongue, is also used as a surgical solution for airway obstruction in some cases (Bouchard C., Management of Obstructive Sleep Apnea: Role of Distraction Osteogenesis, Oral Maxillofacial Surg ClinN Am 21 (20090459-475)).

The design of the pacifier shield has largely been based on safety testing/requirements, ease of manufacturing, skin health and moisture retention under shield, handle grip, sized generally "to fit" at different ages, esthetics and marketability. The approximation of the shield against the face, and particularly against the perioral region, can have a restrictive effect on the posturing of the lower jaw during sucking. The retrusive pressure of the shield against the lower perioral region may play an unreported, but significant role in reducing the beneficial effect that infant pacifier sucking has on the airway of the infant. The shield may in fact, discourage a more forward mandibular posture during sucking of the baglet as the shield is pulled back tight against the inferior perioral area; more specifically the anterior mandibular alveolus, erupting mandibular incisors and mandibular symphysis. This inward suck force creates a strong posteriorly-directed pressure of the shield against the mandible.

SUMMARY

Reproducible standardized biomarkers of the face of infants are available in the literature. Cephalometric radiology, anthropometry, stereo-photometry and most recently apical CT have been used on cohorts of infants of differing ages, sex, inter-racial differences and nationalities. Examples are—Waitzman A. A. et al., Craniofacial Skeletal Measurements based on Computed Tomography: Part II Normal Values and Growth Trends, Cleft Palate-Craniofacial J March 1992 29(2): 118-128; or White J. E. et al., Three Dimensional Facial Characteristics of Caucasian infants without clefts and correlation with Body measurements, Cleft palate-Craniofacial J 41((6)2004:593-602; or Yamanda T et al., Three Dimensional Analysis of Facial Morphology in Normal Japanese Children, CP-Cranio-facial J 39(5) 2002; 517-526. These previously published data allow for development of shield dimensions for different cohorts which then can result in the inventive shield being marketed to populations of different ages, in varying demographics, and/or with varying facial features.

The principle of designing a shield based on available standardized biomarkers of the face, as applied in the current inventive shield, can focus on the following non-limiting biomarkers that most closely describe the key perimeter values and contact points for a shield.

Using normal transverse lip length data (male and female combined) within the first year of life, the period in which the American Academy of Pediatrics recommends pacifier use:

| | | | |
|---|---|---|---|
| 1 month | Mean (1.08") | Range (0.98"-1.26"). | Normal lip position. |
| 1 year | Mean (1.28") | Range (1.14"-1.50"). | Normal lip position. |

Extended lip measurements were extrapolated to be approximately 0.5" greater when using data from older children, extrapolated to infants.

Further analysis of Nasion-Stmion Distance minus Nose length distances provides the dimensions from under the nose (point sub-Nasale) to the lower lip and chin projection (the most posterior point along the symphysis menti, inferior to the infradentale point and superior to the mental protuberance):

| | |
|---|---|
| 1 month | Mean (1.58"-0.88" = 0.70") |
| 1 year | Mean (1.76"-1.02" = 0.74") |

Further continuing the example, we considered the Bigonial Diameter (the greatest distance between the lateral gonial angles of the mandible):

| | | |
|---|---|---|
| 1 month | Mean (2.85") | Range (2.72"-3.07"). |
| 1 year | Mean (3.06") | Range (2.92"-3.27"). |

Note: all illustrative data taken from Young J W; Selected Facial Measurements of Children for Oxygen-Mask Design Report #AM 66-9; Office of Aviation Medicine Federal Aviation Agency, April 1966.

Using this cohort data were are able to design a better fitting shield for nose breathing, a better fitting shield—both fitting the face and allowing for more forward mandible position.

This disclosure features a shield for a pacifier, teether, feeding device, sippy cup or the like, wherein the shield carries a structure that is adapted to be inserted into the mouth of a young child. The shield comprises a body defining an opening at which the structure is carried and an inner surface surrounding this opening and encompassing the perioral areas surrounding the lips. The body defines a superior portion superior to the opening and an inferior portion inferior to the opening, and defines a lateral axis passing laterally through the opening. The superior portion is generally concave laterally on both sides of the vertical midline, to define an inner surface that closely conforms to the upper lip and perioral areas. At least the part of the inferior portion close to and on either side of the vertical midline is offset outward away from the face compared to the inner surface of the superior portion that is close to and on either side of the vertical midline, to allow the mandible to move anteriorly without being inhibited by the shield.

The most lateral parts of the inferior portion of the body may curve back towards the perioral area. The body may define a generally butterfly, round or heart shape from side-to-side. The inferior portion may be angled away from the face. The inner surface of the superior portion may define a curved planar area. At least most of the inferior portion may be offset from the superior portion. The superior and inferior portions may be angled away from the mid-portion to create a convex dome shape. The inferior portion may be offset and angled sufficiently so as to provide room between the shield and face to allow a feeding tube to be placed into the mouth without causing the superior portion of the shield to be thrust into the upper lip. The shield may be supported by contact with the maxillary arch.

The shield may be generally symmetric about both the lateral and vertical midlines so that it can be oriented with the superior portion above or below the opening. The shield may define offset pockets that span the vertical centerline at the peripheries of both the superior and inferior portions, to allow room for the mental protuberance to be able to move forward during use. The shield may further comprise a plurality of support pads that are in contact with the user's cheek infra-orbitally and in the maxillary perioral area. The shield may comprise at least four support pads symmetrically arranged about both the vertical and lateral midlines.

The shield may be dimensioned based on a user cohort derived from one or more of photographic, cephalometric, anthropometric, stereo-photometric and apical CT data. The shield may be constructed and arranged to allow forward movement of the mandible during sucking. The shield may be constructed and arranged to allow downward movement of the mandible during sucking. The shield may be constructed and arranged to allow for maxillary lip support, infra-orbital cheek support, infra nasal support and intermaxillary freeway space support.

Featured in another embodiment is a shield for a pacifier, teether, feeding device, sippy cup or the like, wherein the shield carries a structure that is adapted to be inserted into the mouth of a young child, the shield comprising a body defining a generally butterfly, round or heart shape from side-to-side, and an opening at which the structure is carried. There is an inner surface surrounding this opening and encompassing the perioral areas surrounding the lips, the body defining a superior portion superior to the opening and an inferior portion inferior to the opening, and defining a lateral axis passing laterally through the opening, wherein the superior portion is generally concave laterally on both sides of the vertical midline, to define an inner surface that closely conforms to the upper lip and perioral areas, wherein the inner surface of the superior portion defines a curved planar area, wherein at least the part of the inferior portion close to and on either side of the vertical midline is offset outward away from the face compared to the inner surface of the superior portion that is close to and on either side of the vertical midline, to allow the mandible to move anteriorly without being inhibited by the shield, and wherein the most lateral parts of the inferior portion of the body curve back towards the perioral area, and at least most of the inferior portion is offset from the superior portion.

Featured in yet another embodiment is a shield for a pacifier, teether, feeding device, sippy cup or the like, wherein the shield carries a structure that is adapted to be inserted into the mouth of a young child, the shield comprising a body defining a generally butterfly, round or heart shape from side-to-side, and an opening at which the structure is carried. There is an inner surface surrounding this opening and encompassing the perioral areas surrounding the lips, the body defining a superior portion superior to the opening and an inferior portion inferior to the opening, and defining a lateral axis passing laterally through the opening, wherein the superior portion is generally concave laterally on both sides of the vertical midline, to define an inner surface that closely conforms to the upper lip and perioral areas, wherein at least the part of the inferior portion close to and on either side of the vertical midline is offset outward away from the face compared to the inner surface of the superior portion that is close to and on either side of the vertical midline, to allow the mandible to move anteriorly without being inhibited by the shield, wherein the most lateral parts of the inferior portion of the body curve back towards the perioral area, wherein the shield is generally symmetric about both the lateral and vertical midlines so that it can be oriented with the superior portion above or below the opening, and wherein the shield defines offset pockets that span the vertical centerline at the peripheries of both the superior and inferior portions, to allow room for the mental protuberance to be able to move forward during use.

BRIEF DESCRIPTION OF THE DRAWINGS

Illustrative, non-limiting embodiments are shown in the drawings, in which:

FIGS. 2A-2C illustrate a second embodiment of the shield.

DETAILED DESCRIPTION OF EMBODIMENTS

Figure 1A:
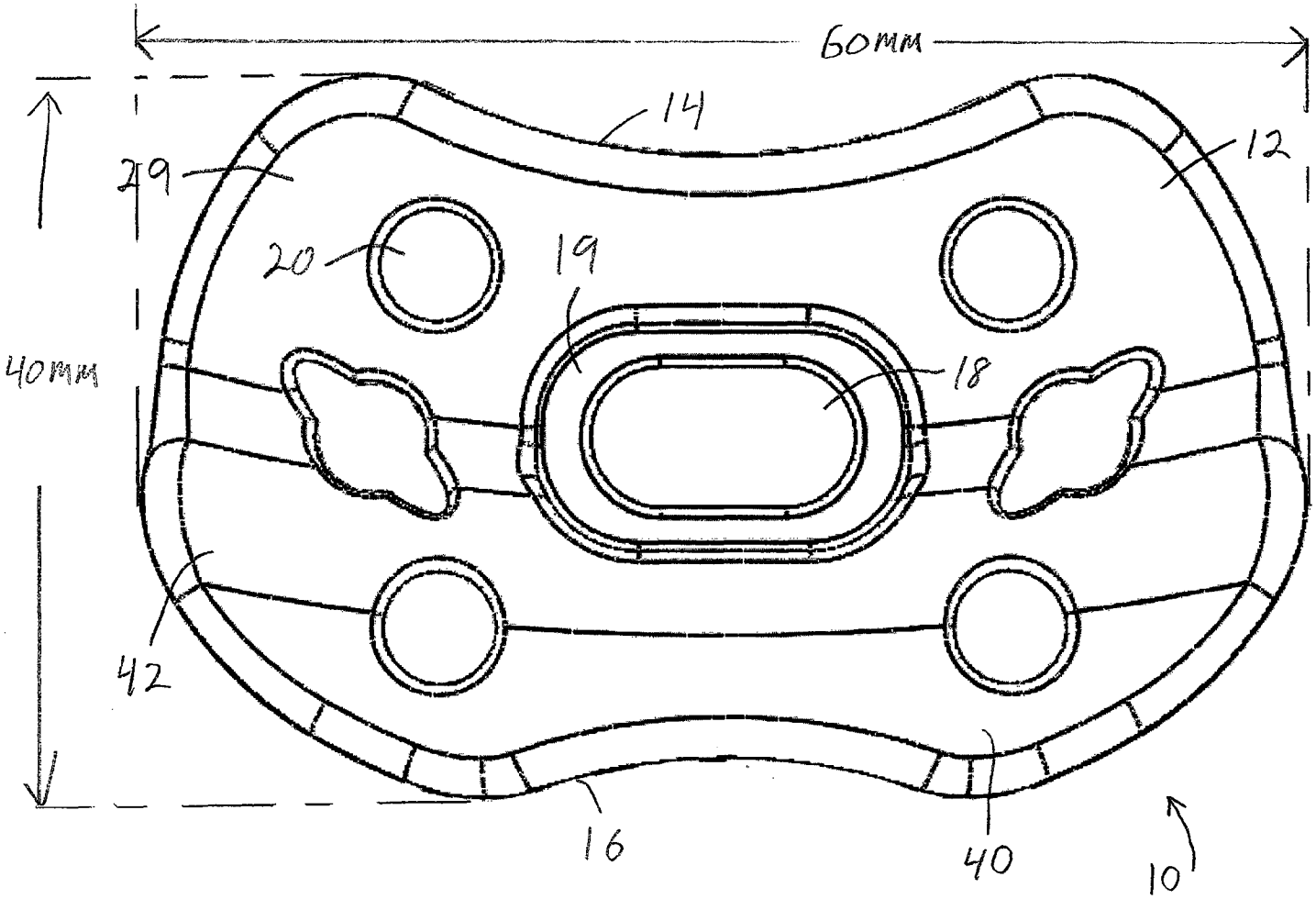
FIGS. 1A-1C illustrate a first embodiment of the shield.

The present invention encourages the perioral forces, created by the shield against the face, to be stabilized against the upper perioral area (maxillary arch, lip, cheek and intermaxillary arch space), with lighter forces (or no force) against the lower perioral area (mandibular arch). The shield can be used in any application, for example as part of pacifiers, teethers, feeding devices/utensils and sippy cups, which include a structure (such as a nipple or baglet) that goes into the infant's mouth.

Part, most of, or all of, the inside surface of the lower or inferior portion (typically the lower half) of the shield is offset from the inside surface of the upper or superior portion of the shield. This moves the inferior portion away from the face. The offset part of the shield is typically offset in the range of about 2 mm to about 10 mm, and more preferably from 2-8 mm, from the upper or superior portion of the shield. The lower offset portion of the shield may also be angled away from the vertical, and away from the face, at more than 0 degrees and up to about 20 degrees. The variation of the degree of angulation of the offset, when angulation is present, will be in part determined by the angle of the bulb or oral device (teether, nipple, spout etc.) which extends from the shield. A greater angle may be used with less of an offset to allow the lower part of the shield to be sufficiently spaced from the face. Similarly, a greater offset may be combined with no angle or a lesser angle.

The shield design takes on different levels of significance when used with different bulb designs. For example, so called cherry shaped and reverse orthodontic shaped bulbs have straight necks (shafts) and will push, slide, and seat (thereby 'angle' upward) into the palate during sucking, and cause greater tipping of the lower part of the shield against the chin than a bulb with a so called orthodontic design which itself is angulated from the neck (shaft) of the bulb, and will thus result in less shield tipping. Thus, greater offset may be needed in a shield for a reverse design in order to prevent the shield from contacting the lower perioral area during use.

The shield, by stabilizing forces against the upper lip, maxillary arch, cheeks and inter-maxillary freeway space, may also have an added benefit of discouraging protrusion of the maxillary front teeth.

Description of Offset:

The offset could be presented in a number of manners. A number of embodiments that accomplish an offset are described below and shown in the drawings.

Embodiment 1

FIG. 1

Figure 1B:
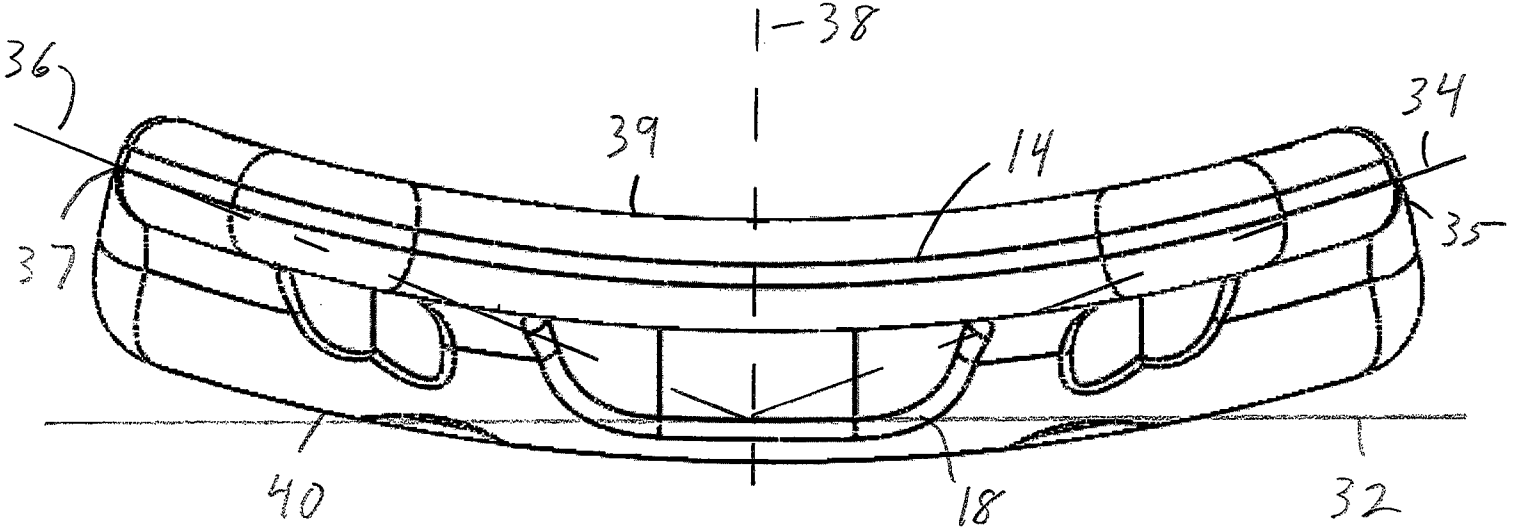
Figure 1C:
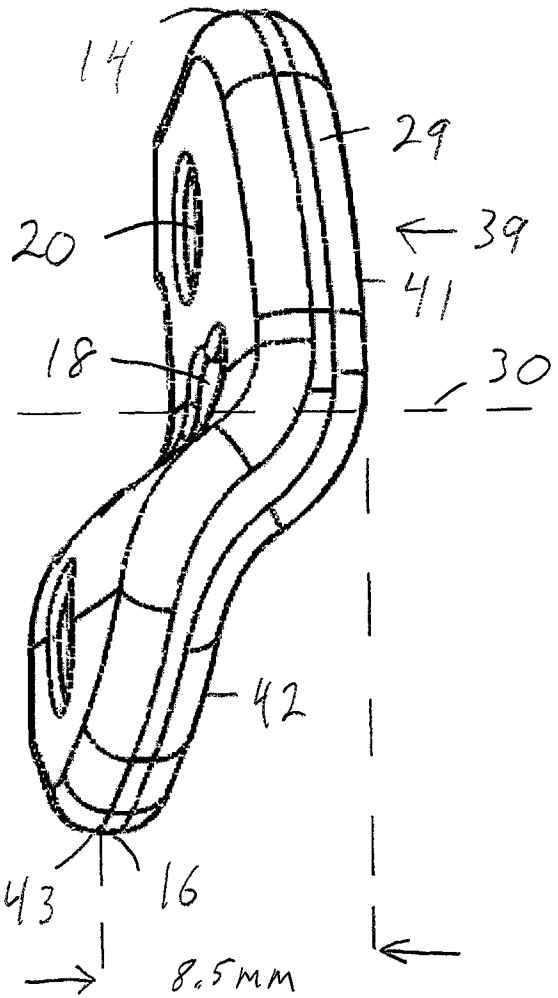
Figure 7A:
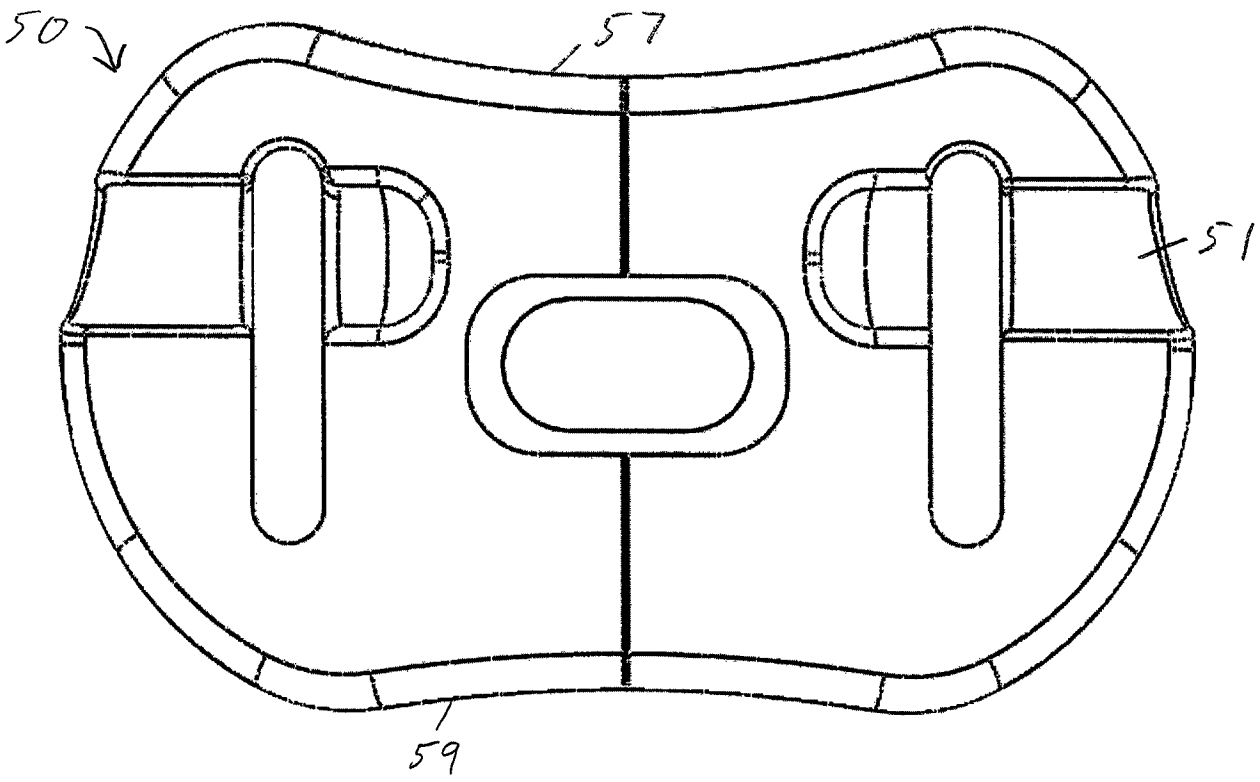

FIGS. 1A-1C show a shield 10 with a conventional pacifier shield "butterfly" shape that is curved inward laterally at a 20 degree angle from its horizontal centerline 30. The 20 degree inward lateral angle can vary; 20 degrees was chosen as a median value. The angle can range from about 10 degrees to about 30 degrees. FIG. 1A is a view of shield 10 from the outside 40 that does not touch the face, showing nipple opening 18 and seating flange 19. FIG. 1B is a top view, and FIG. 1C a side view. Dimensions are in mm. Note that this design is sized for a 9 month+infant. Smaller overall dimensions (scaled down) would be used for shields designed for 0 month, 0-3 months, and other ranges as desired, using the dimensional data and ranges set forth above and otherwise available in literature. Shield 10 comprises unitary molded plastic body 12 that defines top edge 14, lower edge 16, outer surface 40, inner surface 39, central opening 18 (for insertion and seating of a nipple) and openings to provide for passage of air, such as opening 20. The butterfly curvature is such that axes 34 and 36 that emanate from medial bisecting plane 38 and bisect the lateral edges 35 and 37 lie at about a 20 degree angle to plane 32 that is orthogonal to plane 38. Additionally, the inferior (below the nipple) portion 42 is extruded outward (away from the face) (i.e., offset) 2 mm-10 mm (in this example 8.5 mm) from main plane 41 of the superior portion 29 that contacts the infant's face, i.e., the inside surface of the inferior portion 42 at the lowermost extent of the inner face (i.e., point 43) is spaced 8.5 mm from plane 41 that contacts the face.

Embodiment 2

FIG. 2

Figure 2B:
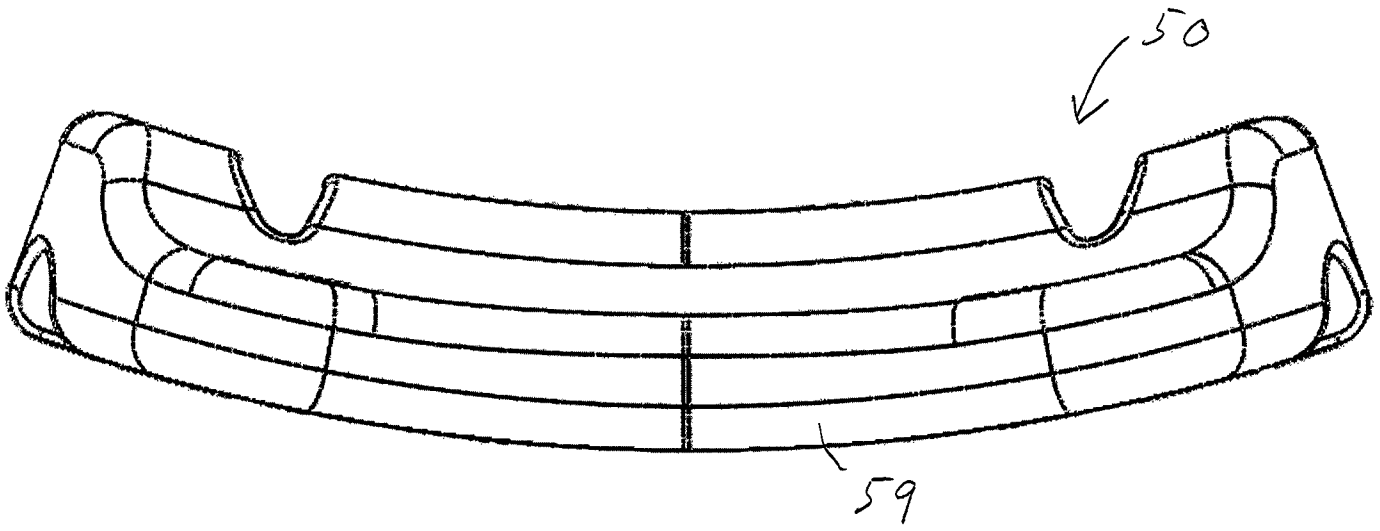
Figure 2C:
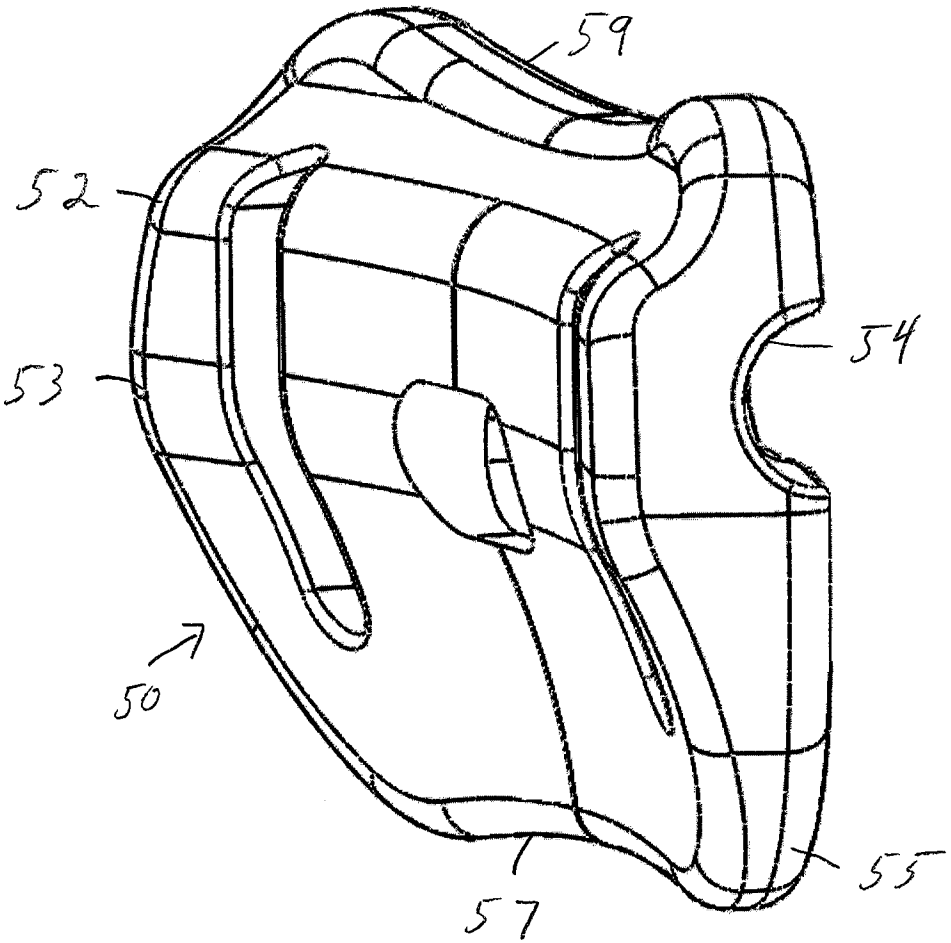

FIGS. 2A-2C are outside, top and inside axonometric views, respectively, of second shield embodiment 50. The footprint of shield 50 is the same at approximately 60 mm wide by 40 mm height, designed for a 12 month+infant, but the initial contact with the infant only comes from the corner of the lips and extends just above the upper lip, essentially at the protruding plane bounded by edges 52-55. This plane defines the innermost surface of the shield, and the areas above and below the plane are offset from the plane. The construction prevents the shield from entering the infant's mouth, but allows the lower part of the shield (below the plane bounded by edges 52-55) to remain away from the infant's face. This design could also be described as two shields in one—a small shield that covers from the corner of the lips up to upper edge 57 and a secondary shield that extends from the plane to lower edge 59 that serves to prevent the shield from being swallowed or inhaled by the infant. This design contains the same curvature inward, 20 degrees, but also shows the same offsets of about 2-10 mm.

Embodiment 3

FIG. 3

Figure 3A:
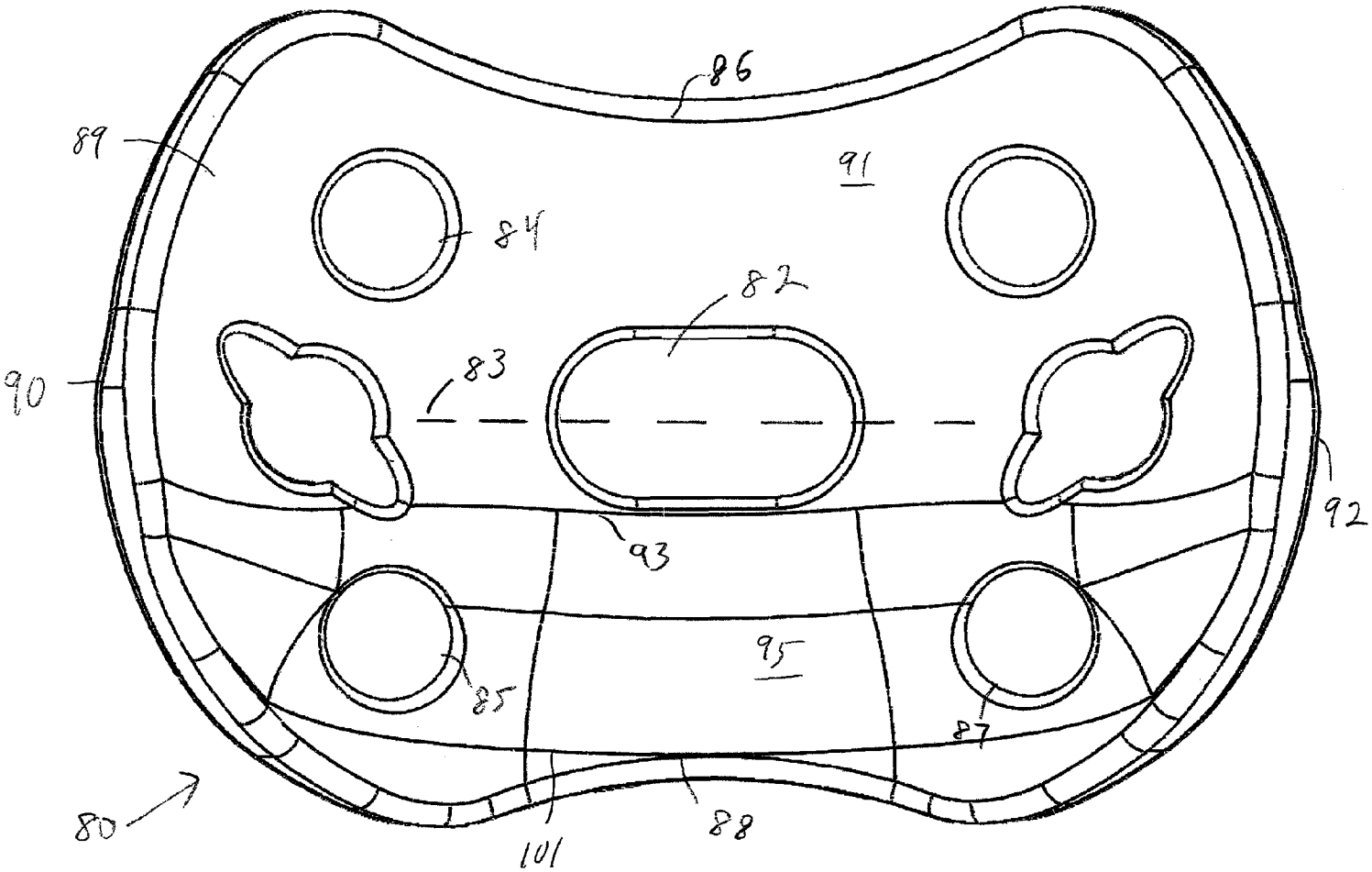
FIGS. 3A-3B illustrate a third embodiment of the shield.
Figure 3B:
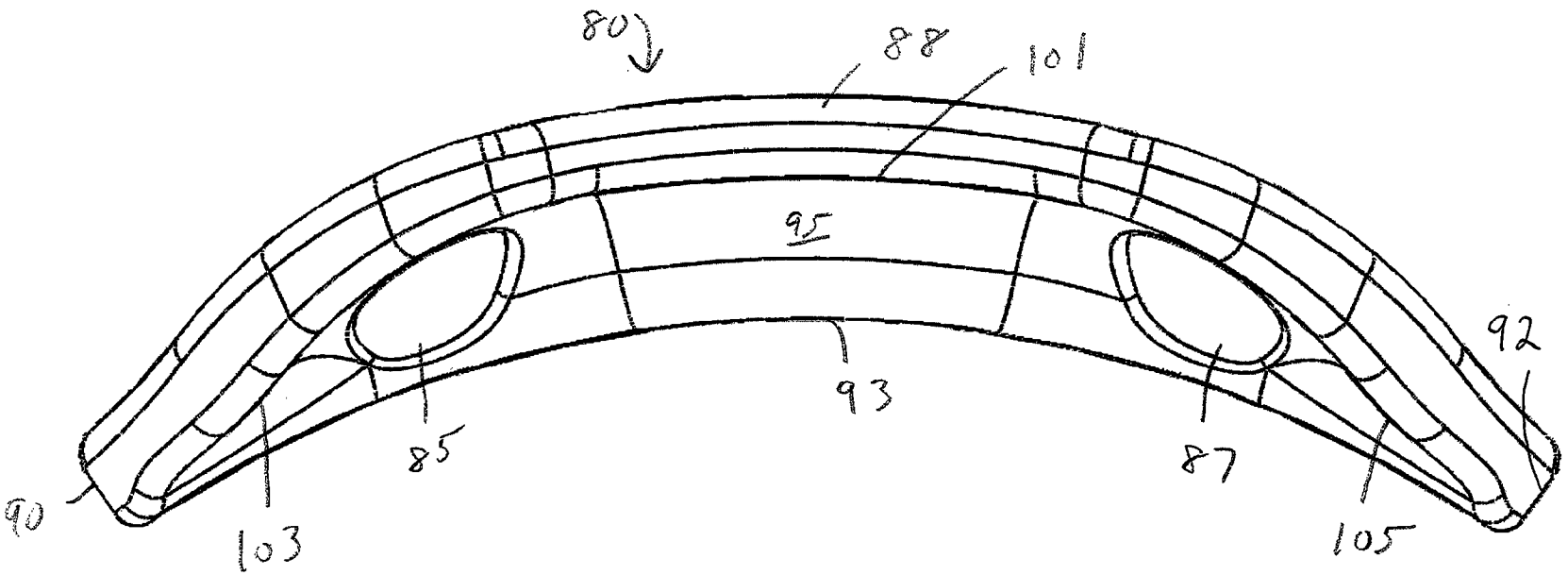

FIGS. 3A-3B are inside and bottom views, respectively, of shield 80 with a conventional pacifier shield "butterfly" shape that is curved inward laterally at a nominal 20 degree angle from centerline, similar to the shield shown in FIG. 1. FIG. 3A is a view of shield from the inside that touches the face, while FIG. 3B is a bottom view. Opening 82 is for the bulb or other structure that goes into the infant's mouth, and is bisected by horizontal axis 83. Above axis 83 is superior portion 91 and below is inferior portion 95. The offset begins at contour line 93 and extends to lowermost inside location 88. The upper extent of inside surface 89 is location 86. Surface 89 is generally concave toward the face to generally follow the contour of the face, thus lateral edges 90 and 92 are located more posteriorly than is the inner part of bulb-receiving opening 82. Air openings 84, 85 and 87 are identified, for context. Inferior portion 95 is sloped away from the face, i.e., offset, to lower contour 101. What differentiates this design from the FIG. 1 design is that the outer parts of inferior portion 95, which end at edges 90 and 92, curve toward the face similar to the curving of superior portion 91, such that lateral inferior inside surface portions 103 and 105 are closer to the face than is central lower location 88. The offset on this design thus creates more of a "pocket" offset located in portion 95 and generally between openings 85 and 87, as visible in FIG. 3B. The pocket provides room for the chin/lower mandible to move unobstructed into when the mandible is in the forward or downward position.

Embodiment 4

FIG. 4

Figure 4A:
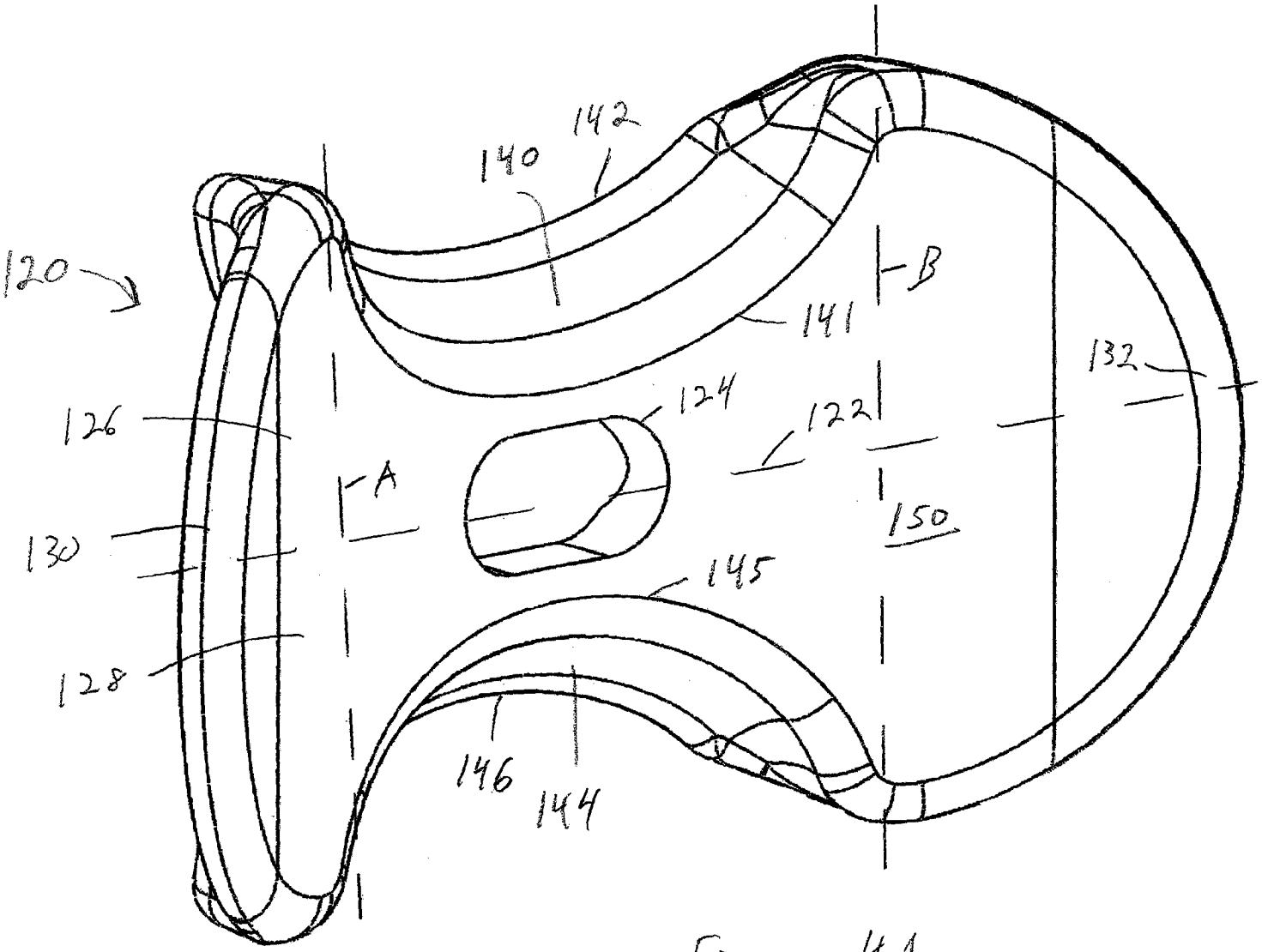
FIGS. 4A-4C illustrate a fourth embodiment of the shield.
Figure 4B:
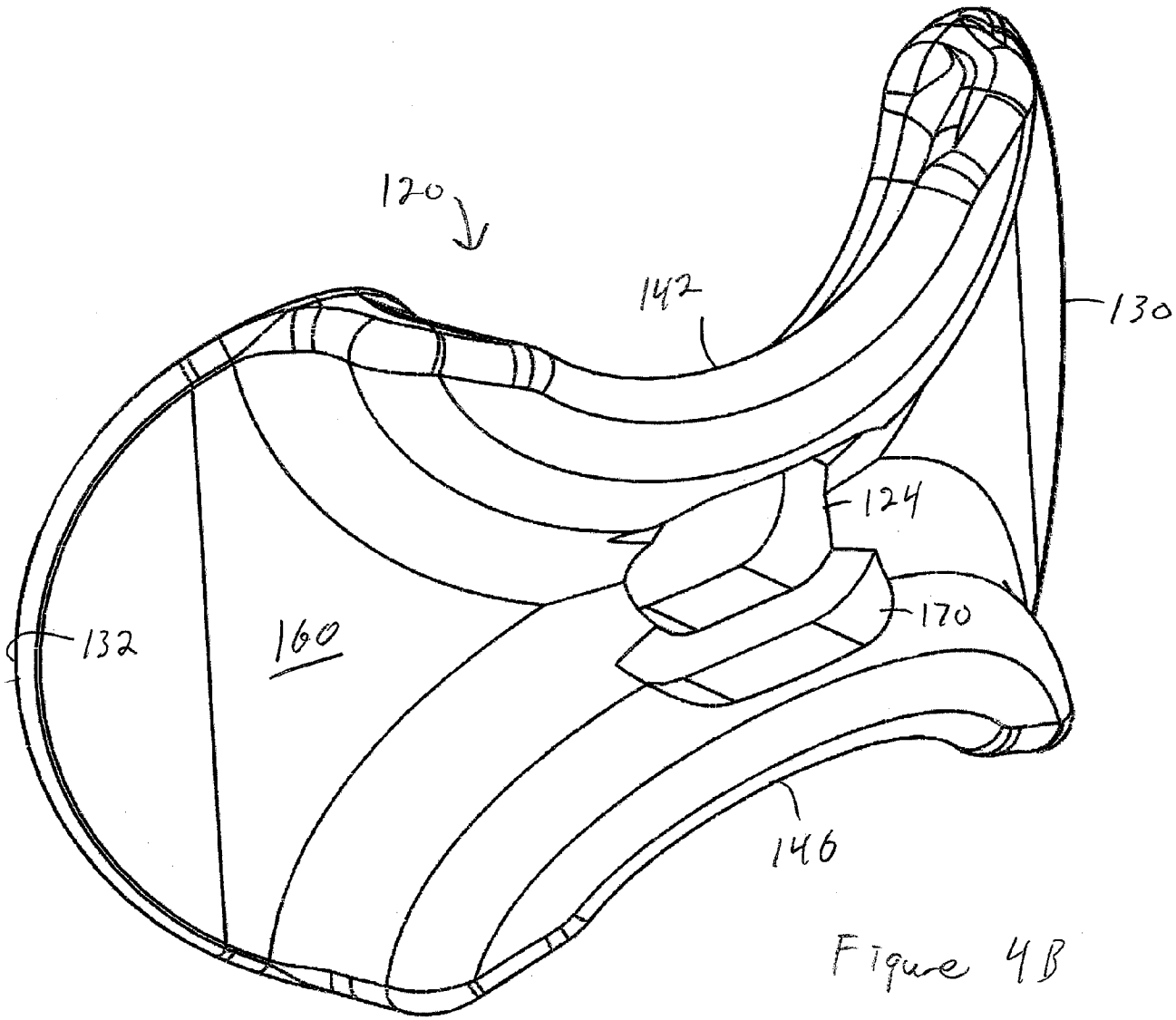
Figure 4C:
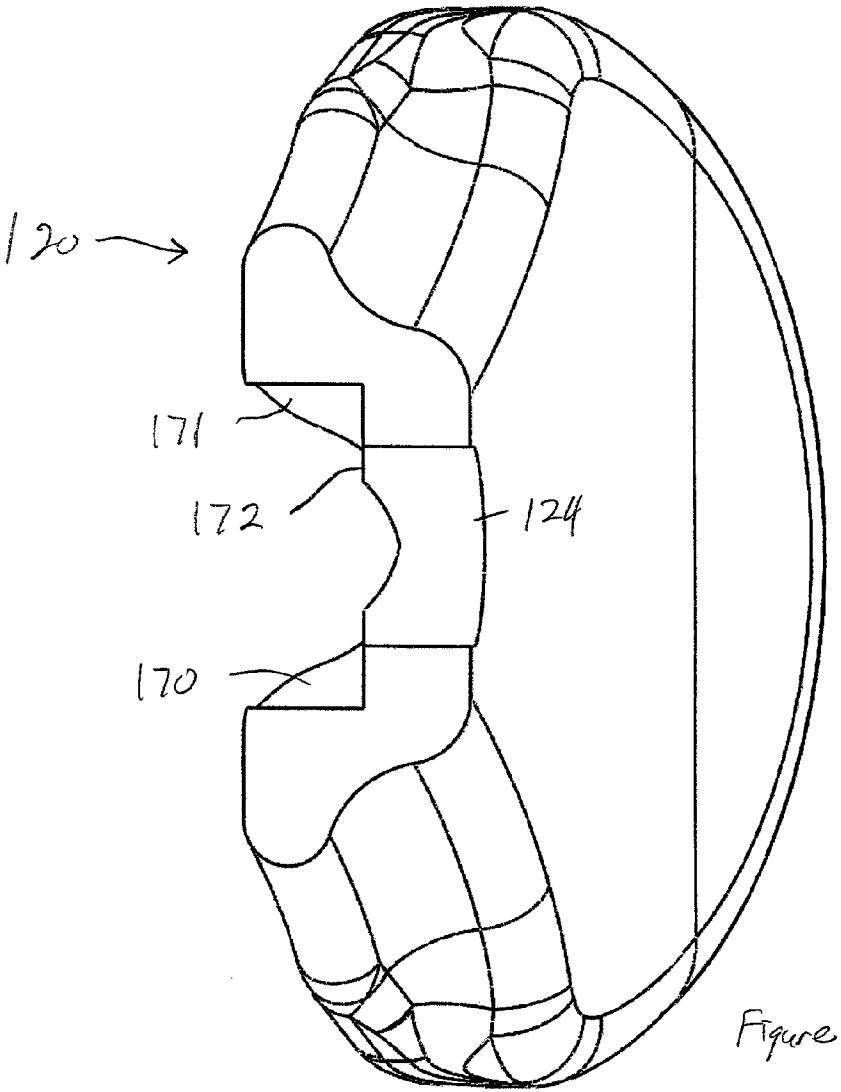

FIGS. 4A-4C are front and back views, and a central vertical cross-section, respectively, of a reversible shield 120; i.e., a shield that is symmetric about lateral plane 122 so that either "upper" or "lower" edges 142 and 146 can be located just below the nose. Thus, both portion 126 and portion 128 can be the superior or inferior portion. Inside surface 150 is shown in FIG. 4A. This shield is for the reversible or cherry baglet (pacifier nipple) design. This shield allows for the chin/mandible to move forward or downward without requiring a top/bottom orientation. The key elements to this shield design are that the outer wings 130, 132 of the shield (generally located laterally of axes "A" and "B," respectively) are designed to firmly contact or "mount" to anatomical structures of the face that are stationary throughout the suck cycle (e.g., the cheeks), and still allow for outward and downward mandibular movement with little or no contact with the shield. Recessed pockets 140 and 144 are bounded by beginning contours 141 and 145 and end contours 142 and 146, respectively. Pockets 140 and 144 are located centrally, above and below nipple-receiving opening 124, and end approximately at vertical axes "A" and "B," outside of which are located wings 130 and 132. Back side recesses 170 and 171 create annular seat 172 against which the nipple (not shown) is seated. A cap (not shown) would also typically cover the back side of the shield to help conceal/anchor the pacifier baglet, as is known in the art.

Embodiment 5

FIG. 4D

Figure 4D:
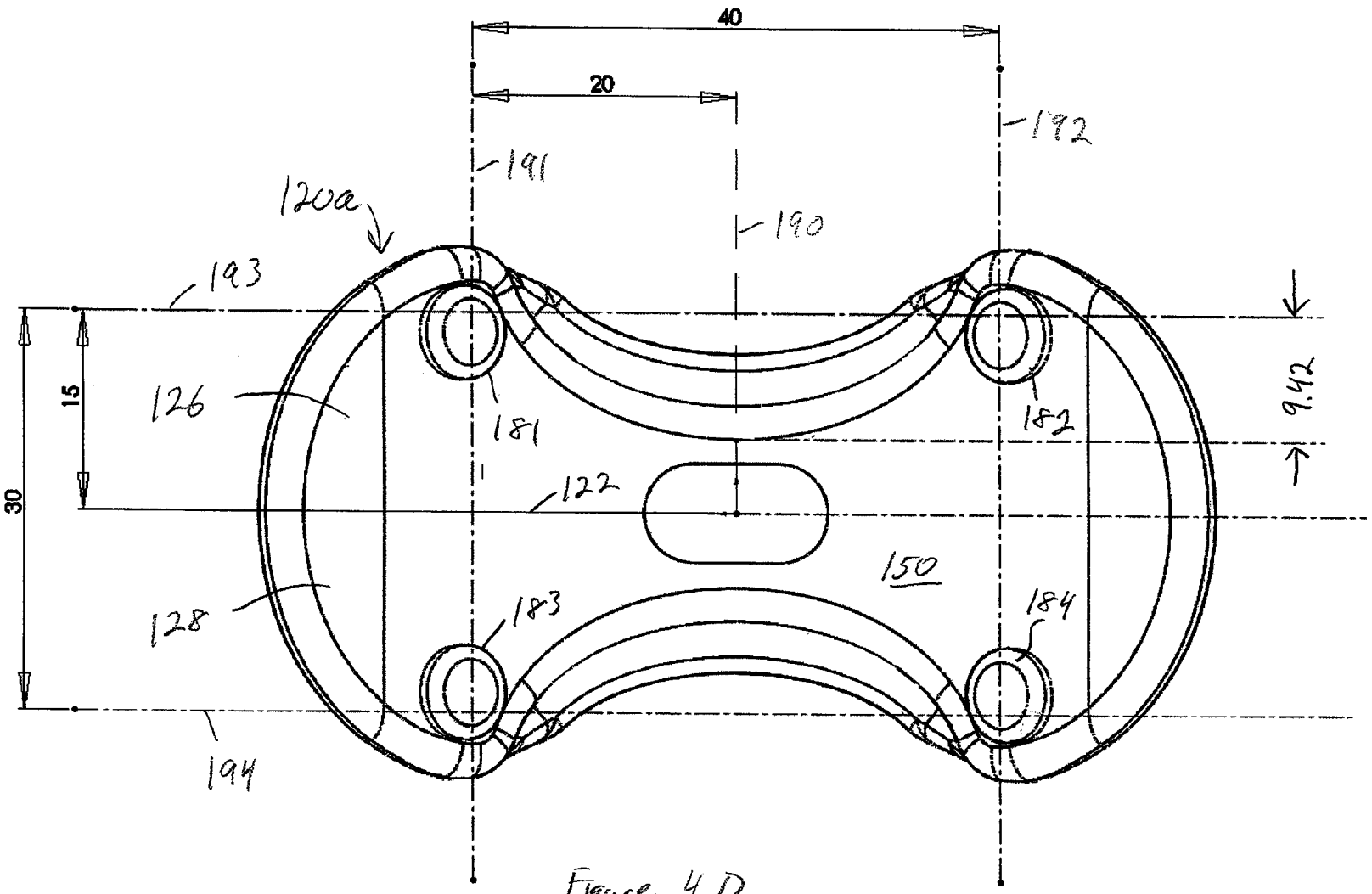
FIG. 4D illustrates a fifth embodiment of the shield.

FIG. 4D is another embodiment of the reversible shield 120*a*, which is very similar in design to shield 120, but with the addition of four support pads 181-184. Using Cranio—facial data (Waitzman et al. and Young J W., supra) these pads are placed nominally 40 mm apart (20 mm off of center of pacifier 190 to center of pads 191, 192, designed for a 12 month+infant) on the superior 126 and inferior 128 inside surface 150 of the shield and function as mini "bumpers." The pads could be placed as close as 25 mm apart (center of pad to center of pad) for younger/smaller infants and as much as 42 mm apart for larger children. Vertical spacing from central axis 122 to axes 193 and 194 is about 15 mm, and can range from about 20 mm for older infants to as little as 10 mm for premature infants. The shape of the pads are preferably circular or elliptical, but can take other shapes as well. Shown is a circular embodiment at 7 mm diameter. Minimum diameter may be as low as 5 mm, and spaced approximately 10 mm offset from center in the superior/inferior direction (which is the same as from axis 122 to axes 193/194). These features may extend out of the shield nominally at 2 mm, +2 mm or −1 mm. Transverse dimensions, although they may vary according to age, sex, nationality and other demographics, would cause the bumpers to contact the infra orbital cheek area and underlying maxillary bone. The pads thus help to anchor the superior portion. The inferior pads lateral placement, however, is too wide to contact the curving mandibular symphysis.

Likewise, when reversed (superior to inferiorly rotated), the same contacts or non contacts with the perioral areas will also apply to this inventive shield design. Other designs and dimensions are obvious to one skilled in the field.

Embodiment 6

FIG. 5

Figure 5A:
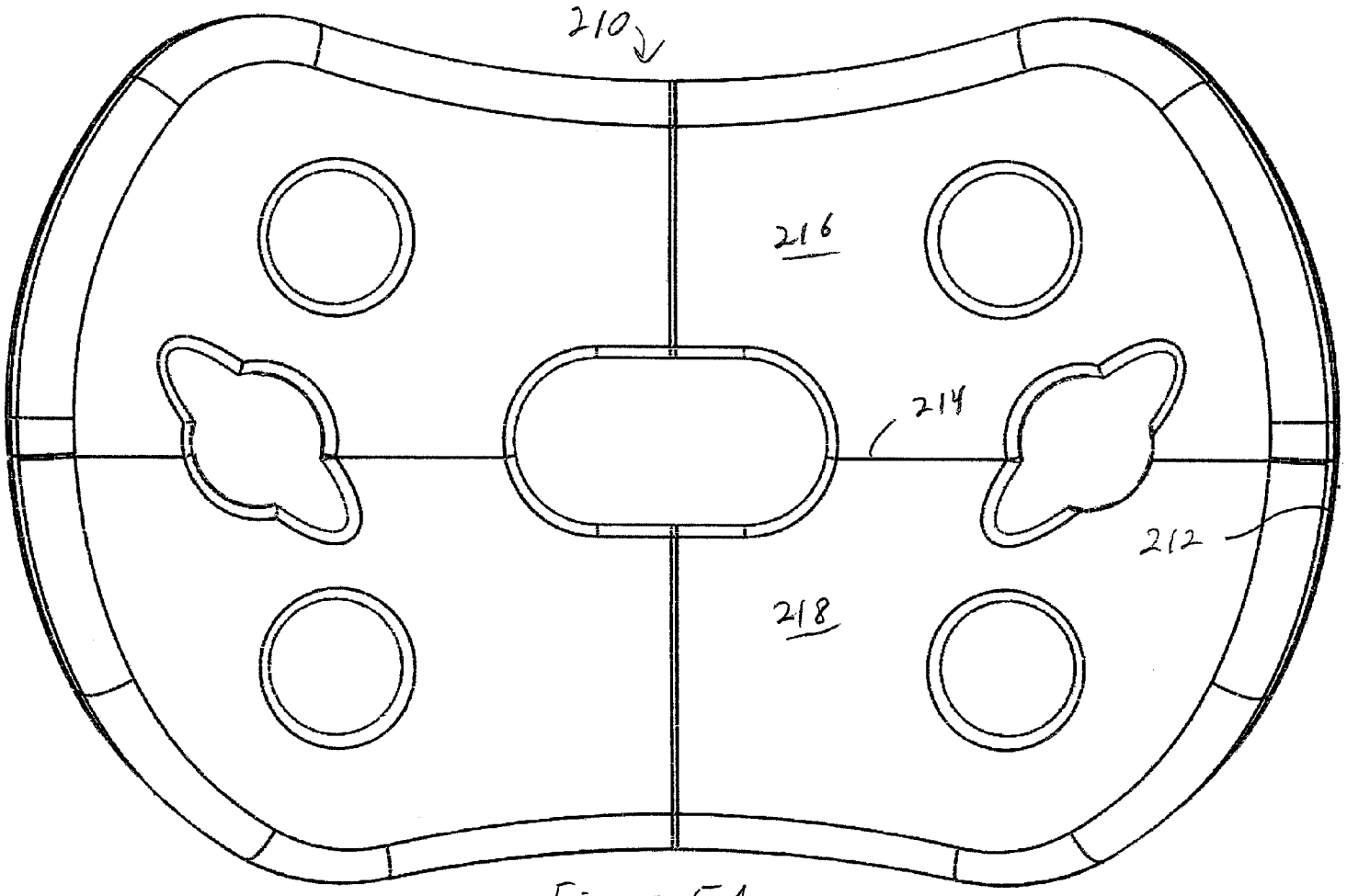
FIGS. 5A-5B illustrate a sixth embodiment of the shield.
Figure 5B:
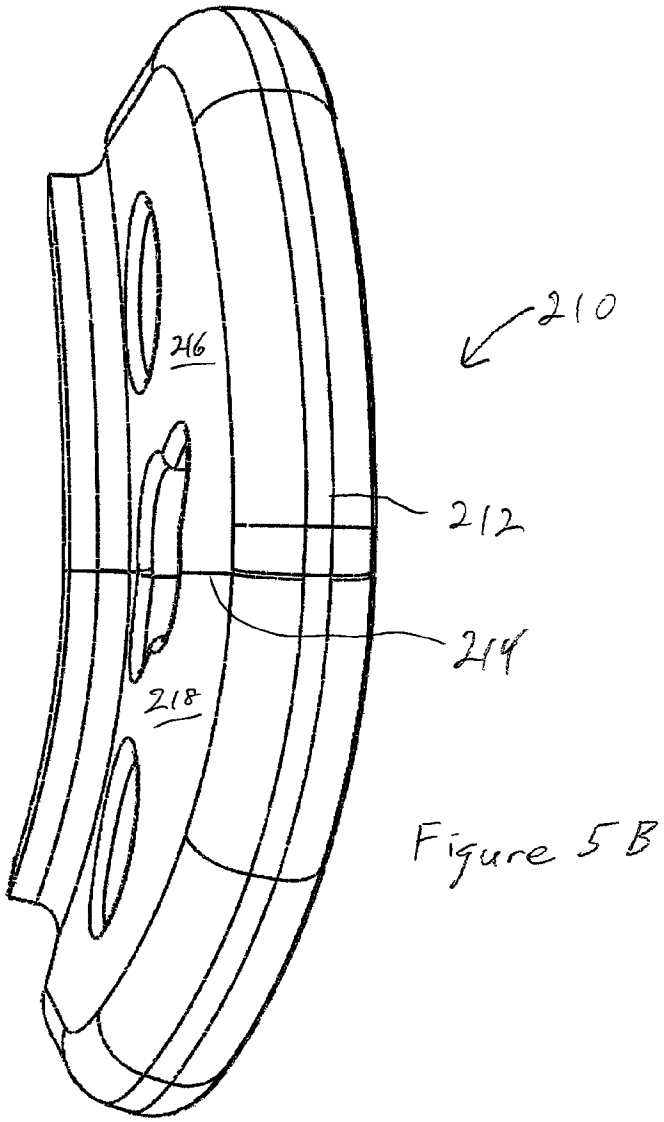

FIGS. 5A and 5B are front and side views, respectively, of another embodiment of shield 210. Shield 210 accomplishes the offset of inferior portion 218 from superior portion 216 (located below and above lateral midline 214, respectively), via angling outward alone, without any planar offset. The angle is typically but not necessarily nominally 20 degrees, to create the "chin pocket" discussed above.

Material Options:

Polycarbonate, polycarbonate frame with silicone overmold, other thermoplastics, urethanes or thermoplastic elastomers that will serve as a rigid barrier (90 A durometer or comprised of sections of softer durometer material, but will contain a rigid section as a frame to pass safety testing/guidelines.

Other embodiments will occur to those skilled in the field and are within the scope of the claims.

We claim:

1. A shield for a pacifier, teether, feeding device, sippy cup or the like, wherein the shield carries a structure that is adapted to be inserted into a mouth of a young child, the shield comprising:

a body having a vertical midline and a horizontal centerline, the body defining a structure seating area at which the structure is carried and an inner surface surrounding this structure seating area;

the body defining a superior portion superior to the structure seating area and an inferior portion inferior to the structure seating area;

wherein the superior portion has inner and outer surfaces that are generally concave laterally on both sides of the vertical midline; and wherein the inferior portion has inner and outer surfaces that are generally concave laterally on both sides of the vertical midline, wherein the outer surface of the inferior portion is extruded outward away from the outer surface of the superior portion and the inner surface of the inferior portion is extruded away from the inner surface of the superior portion, beginning substantially at the horizontal centerline of the body and throughout the inferior portion such that the inferior portion is offset away from the superior portion along its lateral length.

2. The shield of claim 1 wherein the most lateral parts of the inferior portion of the body curve back towards the vertical midline.

3. The shield of claim 1 wherein the body defines a generally butterfly, round or heart shape from side-to-side.

4. The shield of claim 1 that is generally symmetric about both the horizontal centerline and vertical midline so that it can be oriented with the superior portion above or below the opening.

5. The shield of claim 4 defining offset pockets that span the vertical midline at the peripheries of both the superior and inferior portions.

6. The shield of claim 4 further comprising a plurality of support pads on the inner surface.

7. The shield of claim 6 comprising at least four support pads symmetrically arranged about both the vertical midline and the horizontal centerline.

8. The shield of claim 1 wherein the extruded inner surface of the inferior portion extends at two different angles from the vertical midline.

9. The shield of claim 8 wherein the extruded inner surface of the inferior portion extends at a first relatively shallow angle from the vertical midline in the part that is closest to the structure seating area and then extends at a steeper angle to the vertical in the part that is farther from the structure seating area.

10. The shield of claim 1 wherein the extruded inner surface of the inferior portion is sloped at essentially a constant angle from the vertical midline.

11. The shield of claim 1 wherein the extruded inner surface of the inferior portion extends across at least almost the entire width of the inferior portion.

12. The shield of claim 1 wherein the body has side edges, and wherein the superior and inferior portions each define a pocket that is symmetrical about the vertical midline, wherein the pockets are defined by angled portions that begin proximate the structure seating area and extend laterally only part of the way to the edges.

* * * * *